US006024317A

United States Patent [19]

Kovacik et al.

[11] Patent Number: 6,024,317

[45] **Date of Patent: *Feb. 15, 2000**

[54] EXTENSION CORD STORAGE APPARATUS

[75] Inventors: James D. Kovacik, Brecksville; Paul S. Blanch, Broadview Heights; Stanley E. Grzywna, Elyria, all of Ohio

[73] Assignee: Alert Stamping & Manufacturing Co., Ltd., Bedford Heights, Ohio

[ * ] Notice: This patent is subject to a terminal disclaimer.

[21] Appl. No.: 09/036,972

[22] Filed: Mar. 9, 1998

[51] Int. Cl.[7] ..... B65H 75/38

[52] U.S. Cl. ..... 242/405.1; 242/405.2; 242/905; 191/12.2 R

[58] Field of Search ..... 242/405.1, 405.2, 242/905; 191/12.2 R

[56] References Cited

U.S. PATENT DOCUMENTS

| | | | |
|---|---|---|---|
| D. 408,719 | 4/1999 | Kovacik et al. | D8/358 |
| 2,351,379 | 6/1944 | Wehringer | 242/388 |
| 3,598,932 | 8/1971 | Gaudry et al. | 191/12.2 |
| 4,392,661 | 7/1983 | Langenstein . | |
| 4,721,268 | 1/1988 | Lerner et al. | 242/85.1 |
| 4,778,125 | 10/1988 | Hu . | |
| 4,844,359 | 7/1989 | Kato | 242/54 R |
| 4,913,369 | 4/1990 | Lia et al. | 242/96 |
| 5,238,105 | 8/1993 | Smiley | 206/223 |
| 5,613,648 | 3/1997 | Paavila | 242/405.2 |

FOREIGN PATENT DOCUMENTS

| | | | |
|---|---|---|---|
| 2432469 | 2/1980 | France | 242/405.1 |
| 2210844 | 6/1987 | United Kingdom | 242/405.1 |

*Primary Examiner*—Donald P. Walsh
*Assistant Examiner*—Minh-Chau Pham
*Attorney, Agent, or Firm*—MacMillan, Sobanski & Todd, LLC

[57] ABSTRACT

An extension cord storage apparatus which includes a housing having a central body portion with spaced apart side walls and spaced apart end walls; spaced apart arcuate extension walls secured to respective ones of the end walls of the central body of the housing, the arcuate extension walls defining hollow compartment with respective ones of the end walls of the central body of the housing and having opposed openings communicating with respective compartments; and a closure for each of the openings of the hollow compartments.

8 Claims, 3 Drawing Sheets

EXTENSION CORD STORAGE APPARATUS

BACKGROUND OF THE INVENTION

1. Field of the Invention

The invention relates to storage apparatus and more particularly to apparatus for storing electrical extension cord including compartments for storing auxiliary parts such as screws, wire nuts, drill bits and the like.

2. Description of the Prior Art

Conventionally, electrical extension cord storage apparatus includes a rotary wheel around which an extension cord is wound. As a general rule, satisfactory results are attained with the prior art apparatus insofar as the retention of the electrical extension cord is concerned. However, when the cord is used for energizing electrical appliances such as electrical hand tools, for example, it oftentimes becomes necessary to unplug the appliance to obtain auxiliary parts for use with the hand tool from a remote source. This procedure is time consuming and cumbersome.

SUMMARY OF THE INVENTION

The present invention overcomes some of the shortcomings of the prior art by producing an electrical extension cord storage apparatus capable of storing electrical cord about the outside thereof and simultaneously providing storage compartments with hinged access doors in the body of the apparatus for storing auxiliary parts to be used in connection with the associated electrically driven power tools.

A primary object of the present invention is to produce an electrical extension cord storage apparatus having integral storage compartments with hinged covers.

The objects of the invention are typically achieved by producing an electrical cord storage apparatus comprising a housing having a central body portion including spaced apart side walls and associated spaced apart end walls; spaced apart arcuate extension walls secured to respective ones of the end walls of the central body of the housing, the arcuate extension defining hollow compartments with respective ones of the end walls of the central body of the housing and having opposed openings communicating with respective compartments; and a closure for each of the openings of the hollow compartments.

BRIEF DESCRIPTION OF THE DRAWINGS

The above as well as other objects and advantages of the invention will become readily apparent to one skilled in the art from reading the following detailed description of a preferred embodiment of the invention when considered in the light of the attached drawings, in which.

DETAILED DESCRIPTION OF THE PREFERRED EMBODIMENT

Figure 1:
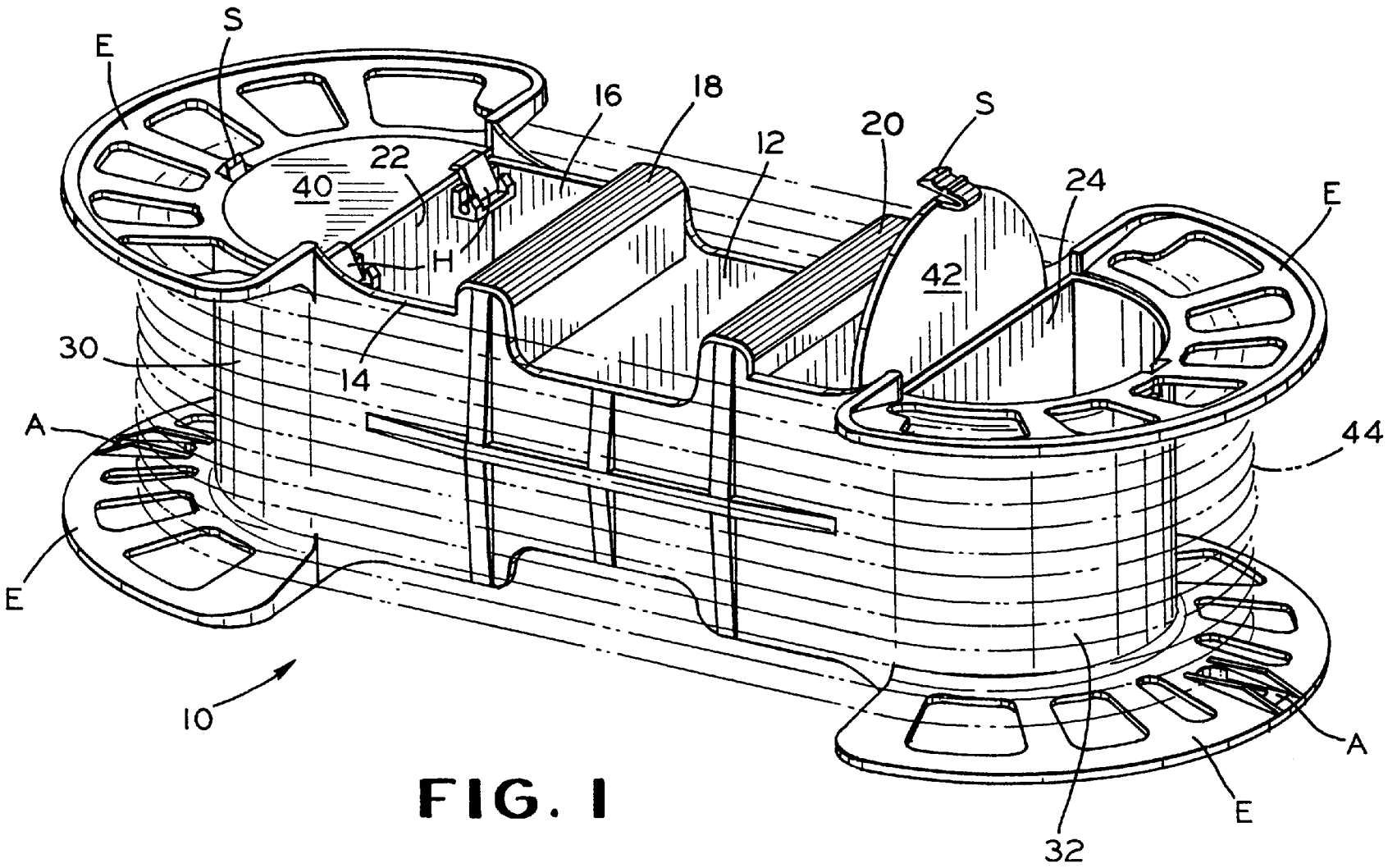
FIG. 1 is a perspective view of an electrical extension cord storage apparatus embodying the features of the present invention.
Figure 2:
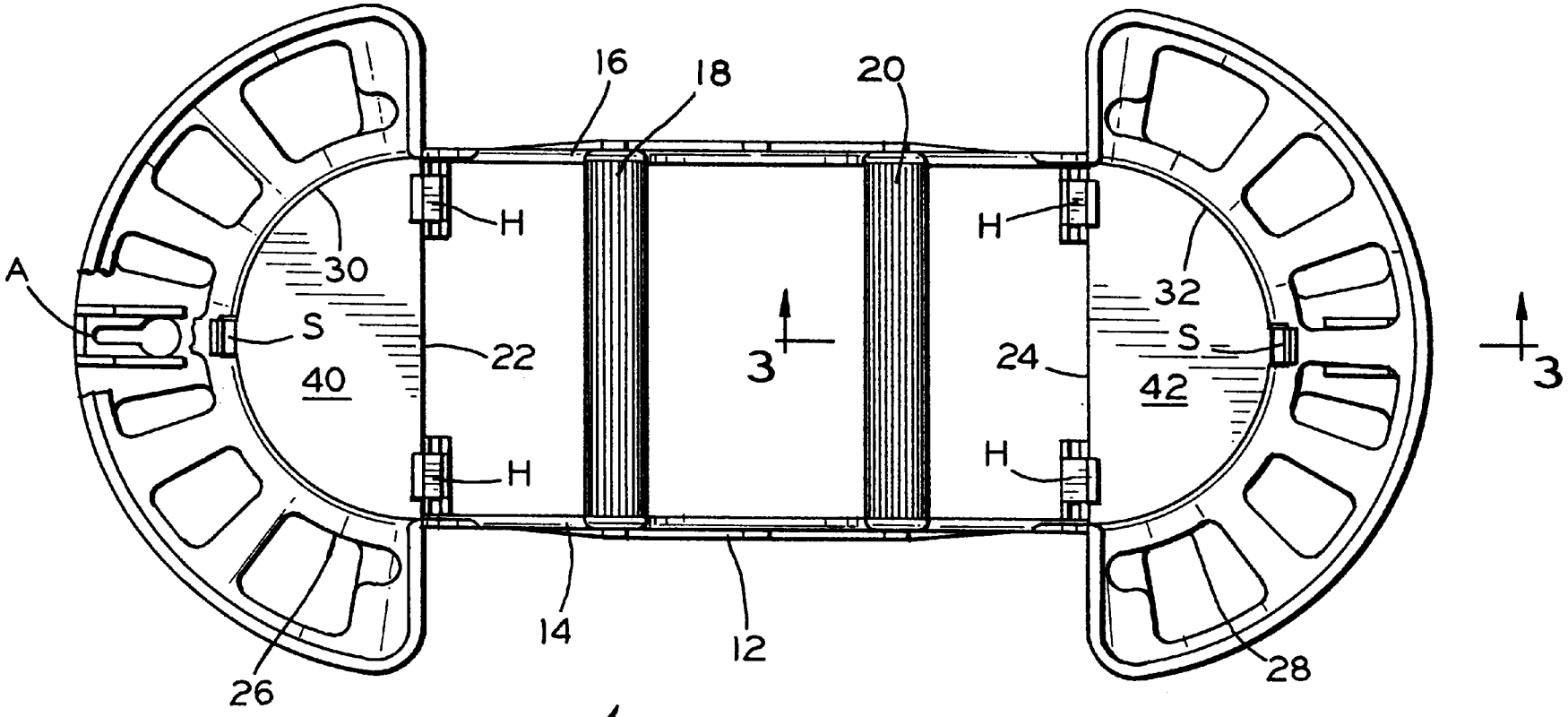
FIG. 2 is a top plan view of the apparatus illustrated in FIG. 1 showing the hinged door of one of the auxiliary storage compartments in an opened position.

Referring to the drawings, there is illustrated an electrical extension cord storage apparatus including a housing generally designated by reference numeral 10 formed of an assemblage of molded plastic components.

Figure 3:
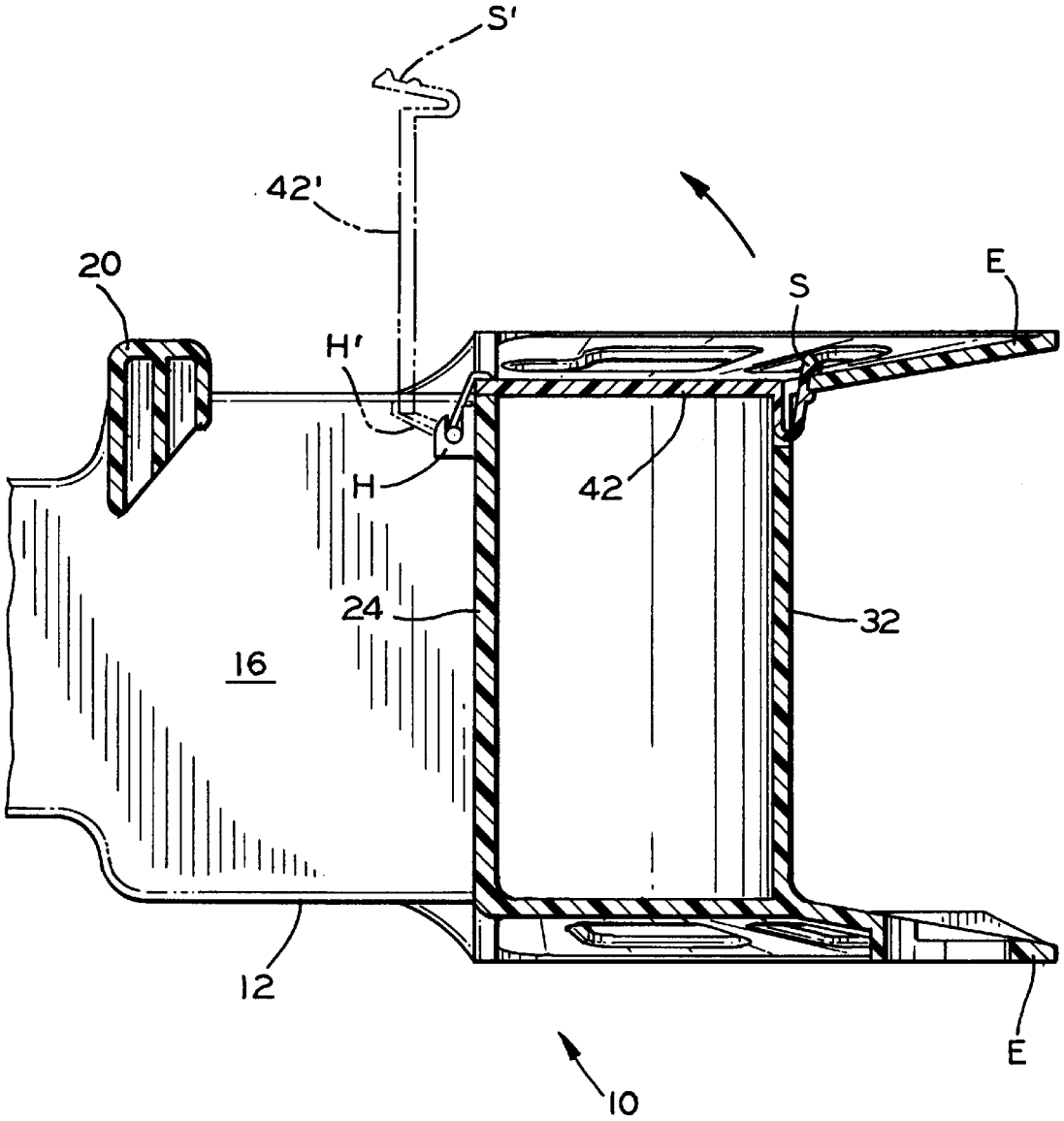
FIG. 3 is a sectional view of the invention taken along line 3—3 of FIG. 2.

The housing 10 includes a central body portion 12 having spaced apart side walls 14, 16 and transversely extending interior walls 18, 20 which are adapted to span the space between the facing inner surfaces of the side walls 14, 16. Also, there are spaced apart end walls 22, 24 which are adapted to span the space between the facing inner surfaces of the side walls 14, 16. The interior walls 18, 20 are a generally inverted W-shape, as shown in FIG. 3, and can function as hand grips for holding the housing 10 as an electrical cord is wound thereon or unwound therefrom and for carrying the housing.

The housing 10 also includes oppositely extending spaced apart end portions 26, 28. The end portions 26, 28 are integral with the side walls 14, 16 of the central portion 12. The end portions 26, 28 include respective curved extension walls 30, 32. The width of the curved extension walls 30, 32 is substantially identical with the width of the respective end walls 22, 24. The interior surfaces of the curved extension walls 30, 32 cooperate with the respective facing surfaces of the end walls 22, 24 to form hollow compartments. Doors are provided to effect a closure of the various compartments. For example, a door 40 is employed to form a closure for one end of the compartment formed by the walls 22 and 30, while a door 42 is employed to form a closure for one end of the compartment formed by the walls 24 and 32. The doors 40 and 42 are suitably hingedly mounted by similar hinge structures H. Similar doors may be employed to effect closure of the opposite ends of the compartments. One of such doors and hinge structure is illustrated in FIG. 3 of the drawings and the components are identified by a prime reference numeral 42' and H', respectively.

It will be understood that the doors 40, 42 and their prime numbered counterparts are maintained in a closed position by snap-locks S and S' formed integral with the doors.

Adjacent each end of the curved walls 30, 32 of the end portions 26, 28, there is a fan-shaped extension E which cooperate with one another to contain the wrapped electric cord 44 as shown in phantom in FIG. 1. Apertures A may be formed in at least two of the extensions E for the purpose of receiving a supporting hook or the like for supporting the assemblage either for storage or in various conditions of use.

In accordance with the provisions of the patent statutes, the present invention has been described in what is considered to represent its preferred embodiment. However, it should be understood that the invention can be practiced otherwise than as specifically illustrated and described without departing from its spirit or scope.

The components of the extension cord storage apparatus may be fabricated from a plastic material such as polypropylene, for example.

The overall apparatus can be readily used for storing electrical extension cord and simultaneously other small parts in the associated storage compartments.

What is claimed is:

1. An extension cord storage apparatus comprising:

a housing having a hollow central body portion extending between a pair of opposite end portions;

said central body portion including a pair of spaced apart generally parallel side walls connected by a pair of spaced apart generally parallel end walls;

each of said end portions including a curved extension wall secured to a respective one of said end walls of said central body portion of said housing, said curved extension walls defining hollow compartments with said respective ones of said end walls, said hollow compartments having opposed openings;

a closure for each of said openings of said hollow compartments;

each of said end portions including a pair of fan-shaped extensions each extending from an associated one of said openings of said hollow compartments; and at least one interior wall extending between said side walls whereby an electrical cord can be wrapped on exterior surfaces of said side walls and said extension walls and retained by said fan-shaped extensions and whereby said interior wall provides a hand grip for a human hand.

2. The extension cord storage apparatus as defined in claim 1 including a hinge structure connecting at least one of said closures to said end wall associated with one of said hollow compartments.

3. The extension cord storage apparatus as defined in claim 1 wherein one of said closures is formed integral with said end wall and said curved extension wall of an associated one of said hollow compartments.

4. The extension cord storage apparatus as defined in claim 1 including a snap-lock attached to at least one of said closures and engaging one of said fan-shaped extensions to selectively maintain said one closure in a closed position.

5. The extension cord storage apparatus as defined in claim 1 wherein at least one of said fan-shaped extensions is provided with an aperture shaped for receiving a supporting hook.

6. An extension cord storage apparatus comprising:

a housing having a hollow central body portion extending between a pair of opposite end portions;

said central body portion including a pair of spaced apart generally parallel side walls connected by a pair of spaced apart generally parallel end walls;

each of said end portions including a curved extension wall secured to a respective one of said end walls of said central body portion of said housing, said curved extension walls defining hollow compartments with said respective ones of said end walls, said hollow compartments each having opposed end openings;

a closure for each of said openings of said hollow compartments, at least one of said closures being attached to said respective end wall by at least one hinge structure and including a snap-lock attached to said one closure and engaging one of said fan-shaped extensions to selectively maintain said one closure in a closed position; and each of said end portions including a pair of spaced outwardly extending fan-shaped extensions, at least one of said fan-shaped extensions being provided with an aperture shaped for receiving a supporting hook whereby an electrical cord can be wrapped on exterior surfaces of said side walls and said extension walls and retained by said fan-shaped extensions.

7. The extension cord storage apparatus as defined in claim 6 including at least one interior wall extending between said side walls and forming a hand grip for said housing.

8. An extension cord storage apparatus comprising:

a housing having a hollow central body portion extending between a pair of opposite end portions;

said central body portion including a pair of spaced apart generally parallel side walls connected by a pair of spaced apart generally parallel end walls;

each of said end portions including a curved extension wall secured to a respective one of said end walls of said central body portion of said housing, said curved extension walls defining hollow compartments with said respective ones of said end walls, said hollow compartments each having opposed openings;

each of said end portions including a pair of spaced outwardly extending fan-shaped extensions, at least one of said fan-shaped extensions being provided with an aperture shaped for receiving a supporting hook;

a closure for each of said openings of said hollow compartments, at least one of said closures being attached to said respective end wall by at least one hinge structure and including a snap-lock attached to said one closure and engaging one of said fan-shaped extensions to selectively maintain said one closure in a closed position; and a pair of spaced apart interior walls extending between said side walls whereby an electrical cord can be wrapped on exterior surfaces of said side walls and said extension walls and retained by said fan-shaped extensions and whereby said interior walls provide hand grips for human hands.

* * * * *